US005984134A

United States Patent [19]

Mario

[11] Patent Number: 5,984,134

[45] Date of Patent: Nov. 16, 1999

[54] TRASH CONTAINER

[75] Inventor: Vincent P. Mario, San Diego, Calif.

[73] Assignee: Vincent P. Mario and Richard Haskel, DBA EZMT, A CA General Partnership, La Jolla, Calif.

[21] Appl. No.: 09/053,410

[22] Filed: Apr. 1, 1998

[51] Int. Cl.[6] ..... B65D 51/00

[52] U.S. Cl. ..... 220/661; 220/495.11; 220/908

[58] Field of Search ..... 220/661, 503, 220/908, 495.11

[56] References Cited

U.S. PATENT DOCUMENTS

| | | | |
|---|---|---|---|
| D. 334,639 | 4/1993 | Kroll . | |
| 1,092,752 | 4/1914 | Segall | 220/503 X |
| 1,364,209 | 1/1921 | Richardson | 220/908 X |
| 1,511,982 | 10/1924 | Schilling | 220/908 X |
| 3,797,643 | 3/1974 | Shupp | 220/503 X |
| 4,765,579 | 8/1988 | Robbins, III et al. | 220/495.11 X |
| 4,923,080 | 5/1990 | Lounsbury | 220/908 X |
| 5,076,458 | 12/1991 | Weiner et al. | 220/908 X |
| 5,183,175 | 2/1993 | Brown . | |
| 5,215,363 | 6/1993 | Warwick, III . | |
| 5,316,170 | 5/1994 | Brown . | |
| 5,348,222 | 9/1994 | Patey . | |
| 5,385,258 | 1/1995 | Sutherlin . | |

*Primary Examiner*—Steven Pollard
*Attorney, Agent, or Firm*—Brown, Martin, Haller & McClain, LLP

[57] ABSTRACT

A trash container is formed from an open fronted housing having a pivotally mounted front wall movable between a closed position closing the open front and an open position displaced from the open front to allow a full trash bag to be removed readily from the housing, without having to lift the bag up and clear of the open upper end of the housing. A releasable locking device releasably locks the front wall in the closed position.

11 Claims, 4 Drawing Sheets

50
16
18
10
14
16
49
49
28
39
39
40
42
38
48
12
45
44
22
42
36
26

22
50
56
60
58
10

50
70
74
73
72
75
79
78
28
32
75
76
32
28
44
12
38
44
45

TRASH CONTAINER

BACKGROUND OF THE INVENTION

The present invention relates generally to trash or garbage containers for holding garbage in bags which may be secured around the rim of the container.

Typically, such containers comprise an open-topped housing of square or round cross-section, with a removable or hinged lid for closing the open top. Smaller trash containers of this type are used to collect garbage within residences and businesses, while larger containers or trash cans located outside or in garages are used to collect garbage from smaller trash containers when full. The larger trash cans or containers may be four feet high or more.

One problem with trash containers of all sizes is that the polyethylene film bags usually used to collect trash within a container can tend to stick to the sides of the plastic trash can when full, making them difficult to lift up out of the can. Another problem, particularly with large trash cans or containers, is the difficulty of lifting a full trash bag upwardly and out of the can. In some cases, a heavy, full trash bag must be lifted upwardly through a distance of four feet or more in order to clear the rim of the trash can. This causes excessive back strain and may result in back injuries.

U.S. Pat. No. 5,348,222 of Patey describes a pedal operated garbage container with improved access to the interior when the lid is opened. In this container, a platform for supporting waste is pivoted to the opposite side walls at its forward edge, and a front wall extends upwardly from the forward edge of the platform. Operation of a pedal pivots the platform upwardly and the front wall outwardly, providing access to the interior. One or more waste receptacles are placed on the platform, and must be lifted out for emptying as needed. Trash cannot be placed directly into the container, nor can a bag be suspended from the rim of the container, due to its design and the pivotal mounting of the lid at the rear edge of the container opening. This is a relatively complex structure, with several internal pivotal linkages within the container linked to the pedal actuator, making it unsuitable for directly receiving trash. Patey does not solve the problem of having to lift a heavy, full trash bag upwardly out of a container which supports the bag.

SUMMARY OF THE INVENTION

It is an object of the present invention to provide a new and improved trash container with easier access for removal of a filled trash bag.

According to the present invention, a trash container is provided which comprises a housing having an integral lower wall, rear wall, and spaced side walls defining an enclosure for containing trash, the housing having an open top and a front opening extending from the open top and downwardly to a location adjacent the lower wall, a front wall pivotally secured to the housing for movement between a first, closed position closing the front opening and a second, open position displaced from the front opening to allow access to the enclosure through the front opening, and a releasable locking device for releasably locking the front wall in the closed position.

Preferably, the lower wall has a front edge and a partial front wall projects upwardly from the front edge to prevent leakage of liquids from the container, which can be a problem when the deposited trash includes wet substances. In a preferred embodiment of the invention, the lower wall includes a portion projecting forwardly from the front edges of the side walls, and the projecting portion has a peripheral, upwardly projecting rim to resist leakage. The front wall has a flat front portion and inwardly projecting side flanges which engage the front edges of the side walls and form a continuation of the side walls when the front wall is in the closed position.

A removable lid is preferably provided for releasably placing over the open top of the housing and closed front wall. The front wall has a peripheral rim aligned with the open top rim of the housing when closed, so that a plastic bag for holding loose trash may be folded down over the top rim of both the housing and closed front wall. Once the bag is full, it is released from the rim and closed with a suitable closure. The locking device is then released to allow the front wall to be opened, and the full bag may be pulled out readily through the front opening of the trash container, without having to lift it through a height of four feet or more to clear the container rim.

The front wall may be pivoted at its lower end to the front end of the lower wall, to pivot downwardly into the open position, or may alternatively be pivoted at one side to one of the side walls to swing outwardly into the open position. Preferably, a handle is provided on the outer face of the front wall for gripping by the user to move the wall between the closed and open positions, and also to act as a stand to support the front wall above a floor when open.

The trash container of this invention makes access and removal of a full garbage bag much easier than in a conventional trash can. Bags can be removed readily simply by pulling them forwards through the open front, so that they are less likely to stick to the sides of the can and rip open.

BRIEF DESCRIPTION OF THE DRAWINGS

The present invention will be better understood from the following detailed description of some preferred embodiments of the present invention, taken in conjunction with the accompanying drawings, in which like reference numerals refer to like parts, and in which.

DESCRIPTION OF THE PREFERRED EMBODIMENT

Figure 1:
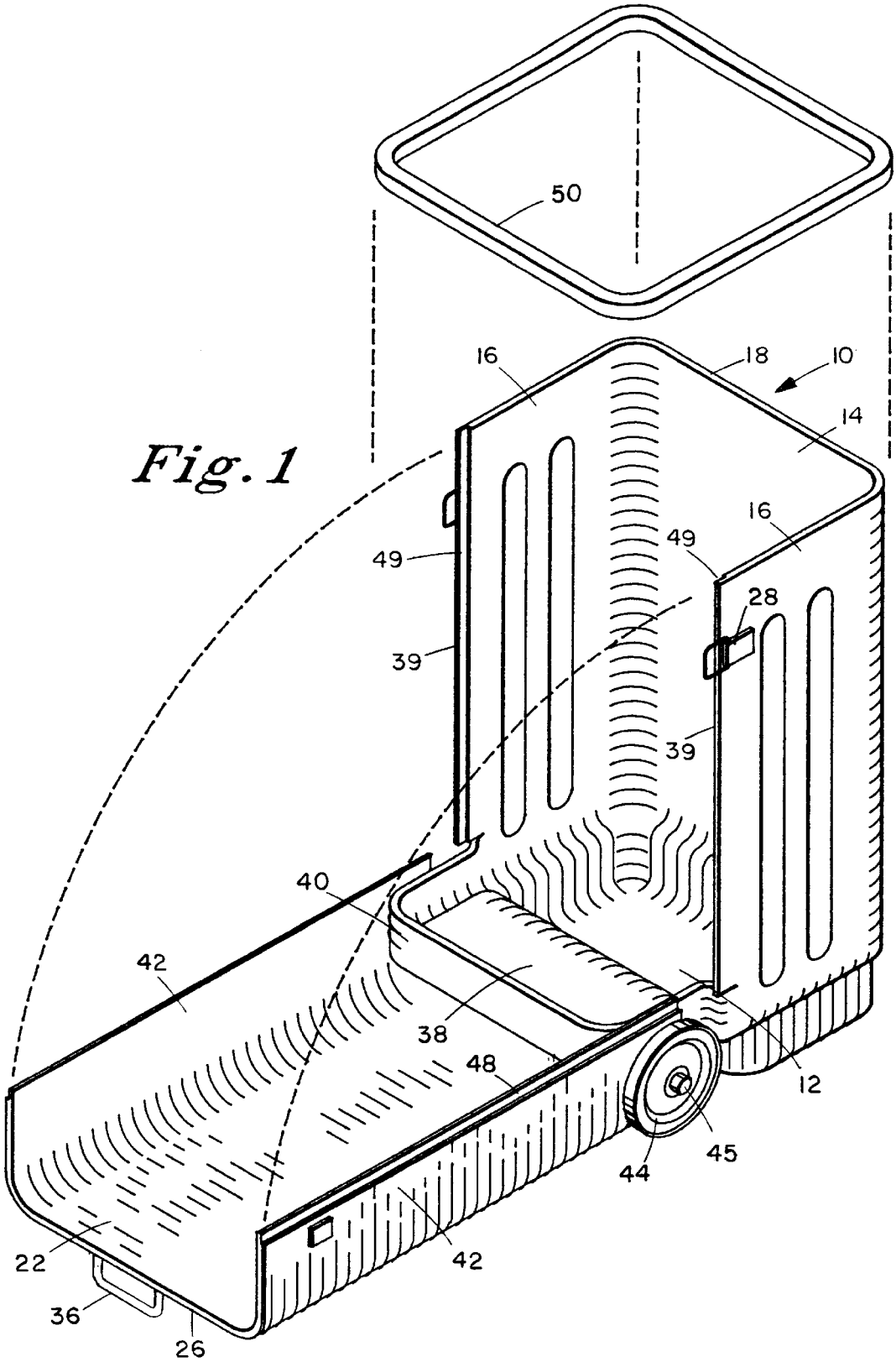
FIG. 1 is a perspective view of a trash container according to a first embodiment of the invention, with the front wall in the open position.

FIGS. 1 to 5 illustrate a trash container according to a first embodiment of the present invention. The trash container has a housing 10 having a lower wall 12, a rear wall 14, and spaced side walls 16 all formed in one piece from plastic or metal material, the housing having an upper rim 18 forming an open top and a front opening for access to the interior of the container. A front wall 22 is pivoted by pivot connection 24 to the lower wall of the housing for movement between a lowered, open position as illustrated in FIG. 1 and a raised, closed position illustrated in FIG. 5 in which the front opening is closed and the upper rim 26 of the front wall forms a continuation of the upper rim 18 of the housing.

Figure 5:
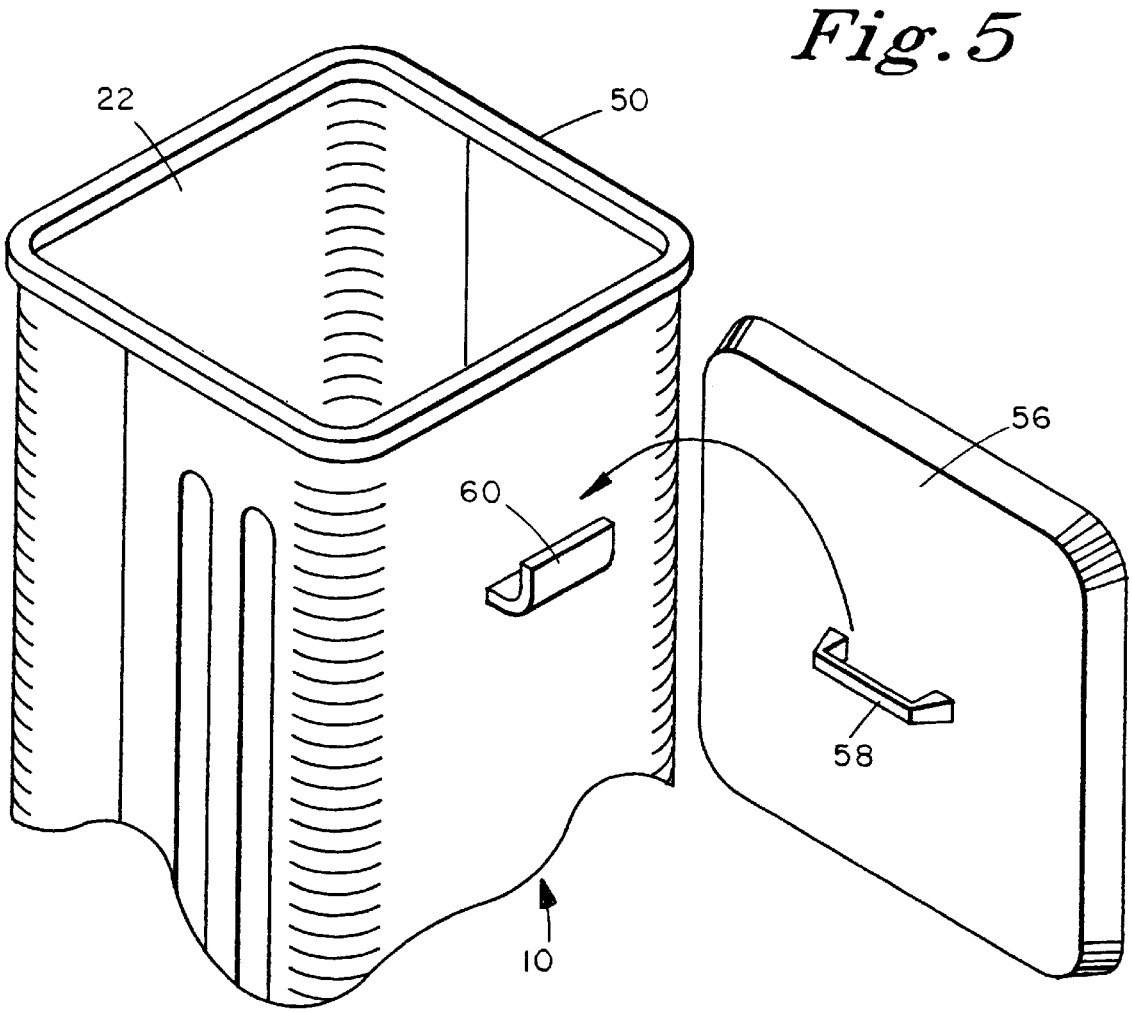
FIG. 5 is a perspective view of an upper portion of the container with the front wall closed, illustrating a removable lid for the container.

A manually releasable latch 28 is provided on each side wall 16 for releasably securing the front wall in the closed position of FIG. 5. The latch mechanism may be of any type, but in the illustrated embodiment a first, pivoted ring member 30 is secured to the respective side wall for engagement with a latch hook member 32 on each side of the front wall. The ring member 30 is pivoted forwardly as indicated by the arrow 33 in FIG. 3 to engage over hook member 32, and the lock 34 is then snapped down in the direction of arrow 35 to secure the latch in the locked position. This is a conventional type of latch, and it will be understood that alternative latches or snap lock devices may be used in other embodiments. The latch 28 is readily releasable when desired, yet locks the front wall securely in the closed position while the trash container is being filled with trash.

A handle 36 is provided on the outside of wall 22 for gripping by the user when pulling the wall down into the open position of FIG. 1, or pushing the wall back up into the closed position of FIG. 5. The handle also acts as a stand when the wall is open, engaging the floor to hold the wall above the floor and prevent damage if the wall is dropped.

In the preferred embodiment of the invention, the lower wall 12 of the housing has a portion 38 projecting forwardly from the front edges 39 of the side walls. The forwardly projecting portion 38 has an upwardly projecting, peripheral rim 40 for preventing leakage of liquids which may collect in the lower end of the container when wet items are deposited in the container. The front wall 22 has side flanges or walls 42 extending perpendicular to the remainder of the front wall and which form a continuation of the housing side walls when the front wall is closed, as indicated in FIG. 5. A pair of wheels 44 are rotatably mounted at opposite sides of the projecting portion 38 on wheel axle 45. The container may be tilted forwardly, using handle 36 for support, so that the wheels 44 engage the ground and can be used to wheel the container from one location to another. Wheels 44 preferably have rubber rims.

Figure 4:
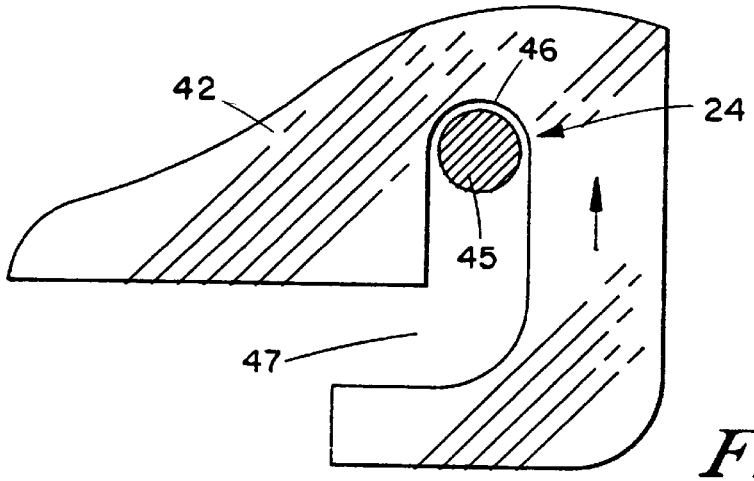
FIG. 4 is an illustration of the pivot connection of the front wall to the wheel axle of the container.

Preferably, the side flanges 42 of the front wall are each pivotally mounted on the wheel axle 45 between the rim 40 of the projecting portion of the lower wall and the respective wheel, as illustrated in FIGS. 1 and 4. Each side flange has a slot 46 which has an inner end 47 for pivotal engagement over axle 45. Since the slot 46 has an open end, the front wall can be completely lifted off the axle 45 if desired, for example for cleaning purposes. The front wall is simply lifted upwardly in the direction of the arrow in FIG. 4, then rearwardly until the axle 45 moves out of the open end of slot 46.

Figure 3:
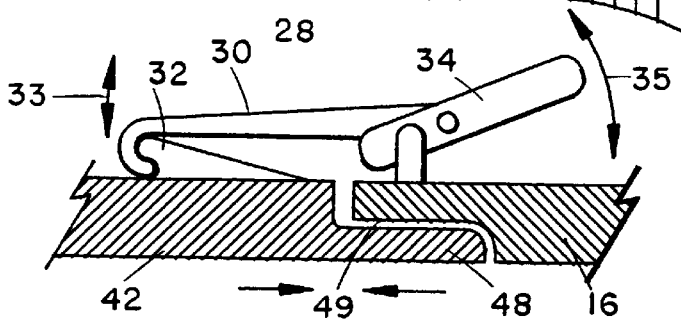
FIG. 3 is a partial cross-section through part of the container side wall and front wall in the closed position, illustrating the lock mechanism.

The side flanges and side walls preferably have mating, outwardly and inwardly directed recessed tongues 48, 49, respectively. The tongues 49 engage over tongues 48 when the front wall is closed and latched, as illustrated in FIG. 3. This provides a more water-tight enclosure when the front wall is closed.

Figure 2:
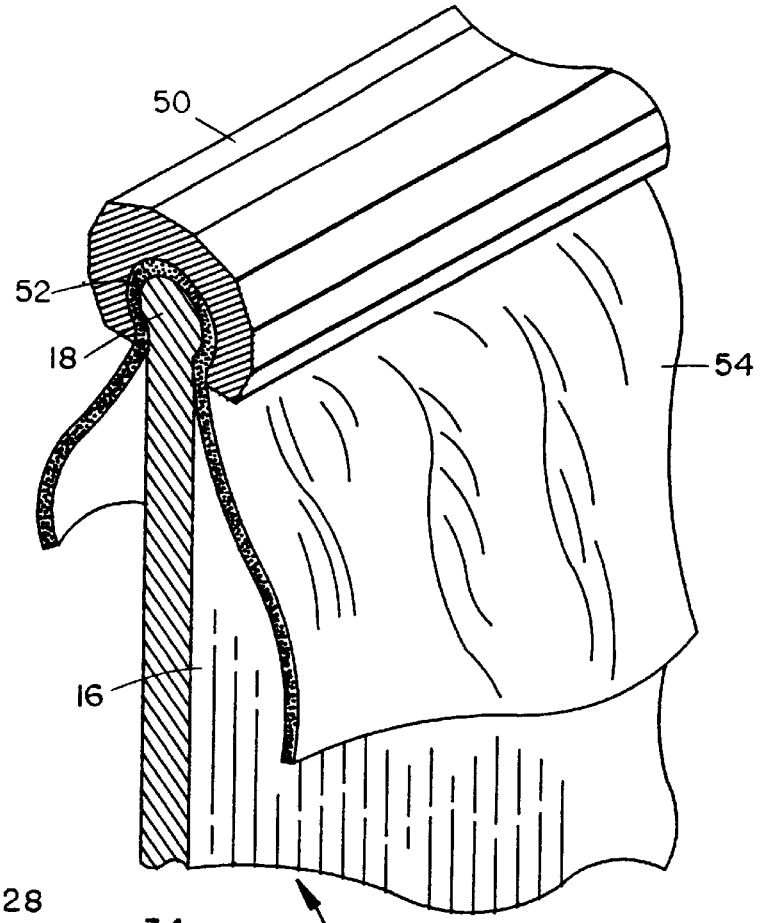
FIG. 2 is a partial perspective view of a portion of the upper rim of the container illustrating retention of a plastic trash bag around the rim.

A removable ring 50 of C-shaped cross-section has a downwardly directed groove 52 designed to snap over the upper rims 18 and 26 of the container and front wall when in the closed position, as illustrated in FIG. 2. The ring 50 is designed to hold an upper edge portion of a plastic garbage bag 54 which is folded outwardly over the rim of the container with the remainder of the bag suspended inside the container. The container also has a removable lid 56 with a handle 58 which may be hooked over hook 60 on the rear wall 14 of the housing, as indicated in FIG. 5.

Although the trash container illustrated in the drawings is of square or rectangular cross-section, it will be understood that it may alternatively be made in other shapes, such as cylindrical. In one example, the container was 4 feet high and 2½ feet by 2½ feet in cross-section, although it may be made in other sizes as desired.

In order to use the trash container, the front wall is initially locked in the closed position of FIG. 5, and an empty trash bag is suspended in the container via retainer ring 50. Household or other trash is then emptied into the trash bag 54 until the bag is full. At this point, the lid 56 is removed and placed over hook 60, and the ring 50 is removed to release the bag. The bag is sealed closed by a suitable closure device. The side latches 28 are then released, and the front wall 22 is pivoted down into the open position of FIG. 1 to open the front of the housing 10. At this point, the full trash bag can be pulled forwards out of the front of the housing and over the upper edge of the front wall, without having to lift it up. This considerably reduces the strain of having to a lift a heavy bag upwards through four feet or more, and reduces the risk of back injury. The full trash bag will slide out easily, and will not stick to the walls of the container since it is released by opening the front wall. The arrangement allows an individual to easily remove full and heavy trash bags without requiring assistance.

Once a full trash bag has been removed, the front wall is pivoted back up into the closed position and locked by latches 28, and a new empty bag may then be suspended in the container to receive more trash. When the front wall is closed, the container is fully sealed to resist leakage of liquids out of the container or moisture entering the container.

Figure 6:
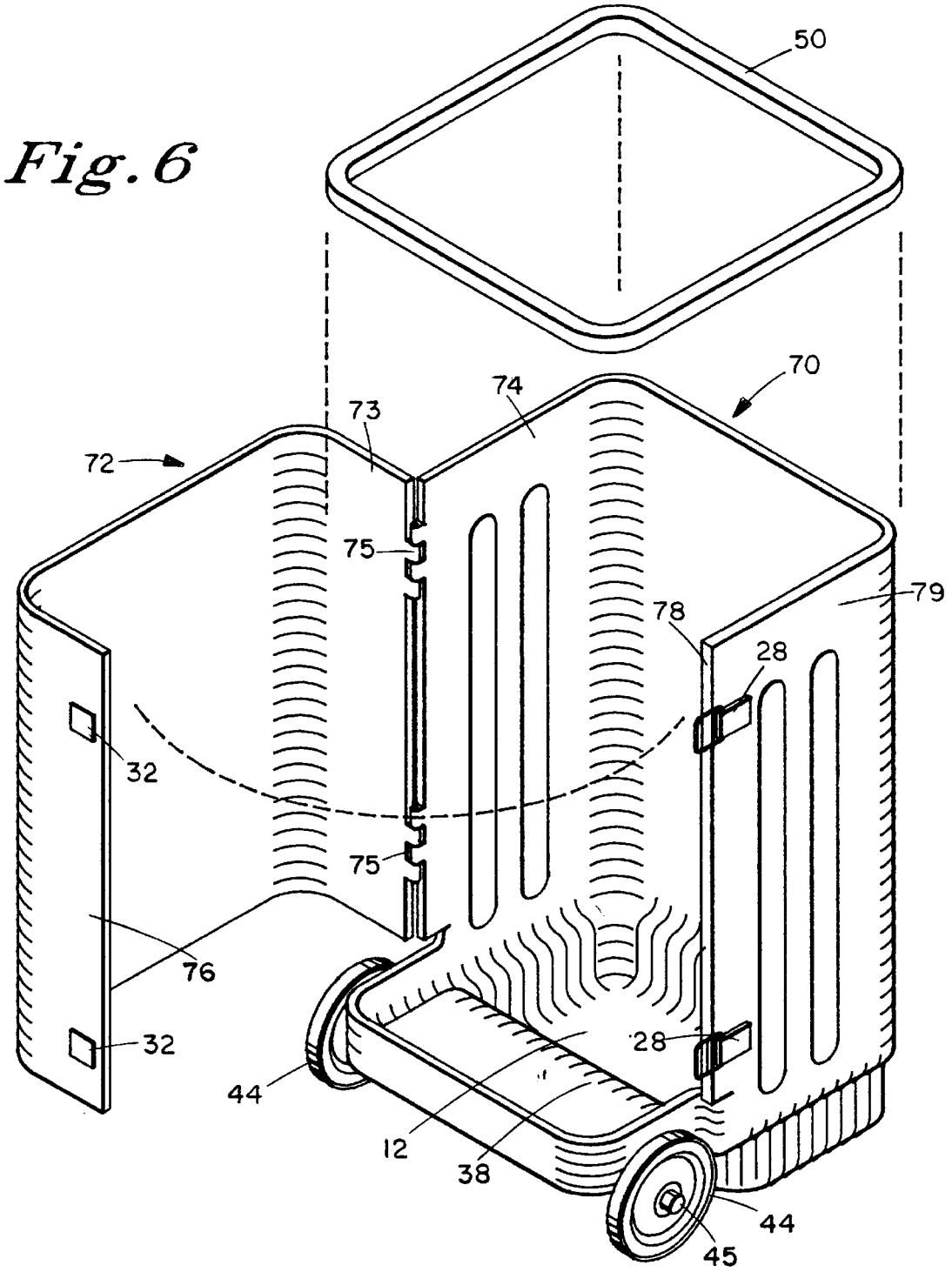
FIG. 6 is a perspective view similar to FIG. 1 illustrating a modified trash container.

In the embodiment of FIGS. 1 to 5, the front wall or door is designed to swing up and down between the closed and open positions. FIG. 6 illustrates an alternative embodiment in which housing 70 has a front wall 72 pivoted at one side 73 to side wall 74 of the housing, so that it swings outwardly to one side, as indicated by the dotted line. This embodiment is otherwise identical to that of FIGS. 1 to 5, and like reference numerals have been used for like parts as appropriate.

As in the first embodiment, housing 70 has a lower wall 12 with a forwardly projecting portion 38 having a peripheral rim 40, and a pair of wheels 44 are rotatably mounted on an axle on opposite sides of portion 38. The front wall 72 has a first side flange 73 secured via hinges 75 to the side wall 74, and a second side flange 76 for engaging the forward edge 78 of the opposite side wall 79 of the housing when the front wall is swung closed. A pair of spaced latches 28 are provided adjacent the forward edge 78 of the side wall 79 for releasably securing the front wall in the closed position.

This arrangement is very similar to the first embodiment, except that the front wall is pivoted outwardly to one side of the open front of the housing about hinges 75 rather than swinging down as in FIGS. 1 to 5. When the front wall is open as in FIG. 6, a full trash bag can be readily removed since it only has to be lifted upwards a short distance in order to clear rim 40. This embodiment therefore has all the advantages of the first embodiment.

The above embodiments are of relatively simple and inexpensive construction, and will operate reliably over the lifetime of the trash container. The trash container avoids the problems of full garbage bags sticking to the sides of a traditional trash can and potentially tearing when attempts are made to remove them from the can. Another major advantage of the embodiments described above is that a user does not have to lift a full garbage bag upwardly through a relatively large distance to clear the upper rim of the container, but simply has to slide the bag forwardly out of the open front, eliminating excessive strain and potential back injury. This trash container is particularly helpful for elderly or physically challenged individuals to provide them with a relatively low effort way to remove a filled garbage bag from a trash container. The front wall can be readily unlatched and opened for access to a filled bag.

Although some preferred embodiments of the invention have been described above by way of example only, it will be understood by those skilled in the field that modifications may be made to the disclosed embodiments without departing from the scope of the present invention, which is defined by the appended claims.

I claim:

1. A trash container, comprising:

a housing having an integral lower wall, rear wall, and spaced side walls defining an enclosure for containing trash, the housing having an open top and a front opening extending from the open top and downwardly to a location adjacent the lower wall;

a front wall pivotally secured to the housing for movement between a first, closed position closing the front opening and a second, open position displaced from the front opening to allow access to the enclosure through the front opening;

a releasable locking device for releasably locking the front wall in the closed position; and the front wall having a forward portion and a wheel axle being mounted on said forward portion, said axle having opposite ends projecting from opposite sides of said forward portion, and first and second wheels are rotatably mounted on the respective opposite ends of said axle, said front wall being pivotally mounted on said wheel axle.

2. The container as claimed in claim 1, wherein the lower wall has a front edge and a rim projects upwardly from the front edge to prevent leakage of liquids from the container.

3. The container as claimed in claim 1, wherein the side walls have front edges and the lower wall includes a portion projecting forwardly from the front edges of the side walls, the projecting portion having a peripheral, upwardly projecting rim to resist leakage.

4. The container as claimed in claim 3, wherein the front wall has a flat front portion and inwardly projecting side flanges which engage the front edges of the side walls and form a continuation of the side walls when the front wall is in the closed position.

5. The container as claimed in claim 1, wherein the wheel axle extends through to a forward edge of the lower wall and the front wall is movable downwardly between said closed position and said open position.

6. The container as claimed in claim 5, wherein each side wall has a releasable locking device for releasably locking opposite sides of the front wall in the closed position.

7. The container as claimed in claim 1, including a removable lid for releasably closing the open top of the housing and closed front wall.

8. The container as claimed in claim 1, wherein the housing and front wall each have an upper rim, the upper rim of the front wall being aligned with the top rim of the housing when closed.

9. The container as claimed in claim 8, including a releasable ring of C-shaped cross-section for releasable engagement over the aligned top rims of the front wall and housing for holding the edge of a trash bag folded over the top rims.

10. The container as claimed in claim 1, wherein the front wall has an outer face and a handle is provided on the outer face of the front wall for gripping by the user to move the wall between the closed and open positions.

11. The container as claimed in claim 1, wherein the front wall is removably mounted on said wheel axle.

* * * * *